US007954927B2

(12) United States Patent
Hart et al.

(10) Patent No.: US 7,954,927 B2
(45) **Date of Patent: *Jun. 7, 2011**

(54) NOZZLE MEMBERS, COMPOSITIONS, AND METHODS FOR MICRO-FLUID EJECTION HEADS

(75) Inventors: Brian C. Hart, Georgetown, KY (US); Gary A. Holt, Jr., Lexington, KY (US); Melissa M. Waldeck, Lexington, KY (US); Sean T. Weaver, Union, KY (US); Gary R. Williams, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/024,346

(22) Filed: Feb. 1, 2008

(65) Prior Publication Data

US 2008/0122895 A1 May 29, 2008

Related U.S. Application Data

(62) Division of application No. 11/239,799, filed on Sep. 30, 2005, now Pat. No. 7,364,268.

(51) Int. Cl.
*B41J 2/14* (2006.01)

(52) U.S. Cl. ..... 347/47; 347/44

(58) Field of Classification Search ..... 347/20, 347/44, 47, 56, 61–65, 67

See application file for complete search history.

(56) References Cited

U.S. PATENT DOCUMENTS

| | | | | |
|---|---|---|---|---|
| 4,394,670 | A | 7/1983 | Sugitani et al. | |
| 5,198,834 | A | 3/1993 | Childers et al. | |
| 5,686,224 | A | 11/1997 | O'Neill | |
| 6,024,440 | A * | 2/2000 | Murthy et al. | 347/65 |
| 6,162,589 | A | 12/2000 | Chen et al. | |
| 6,204,182 | B1 | 3/2001 | Truninger et al. | |
| 6,303,274 | B1 | 10/2001 | Chen et al. | |
| 6,406,607 | B1 | 6/2002 | Hirsh et al. | |
| 6,520,627 | B2 * | 2/2003 | Chen et al. | 347/63 |
| 6,520,628 | B2 | 2/2003 | McClelland et al. | |
| 6,558,968 | B1 | 5/2003 | Ramamoorthi et al. | |
| 6,644,789 | B1 | 11/2003 | Toews, III | |
| 6,682,874 | B2 | 1/2004 | Ramaswami et al. | |
| 6,902,259 | B2 | 6/2005 | Chen et al. | |
| 7,152,951 | B2 | 12/2006 | Maher et al. | |
| 7,364,268 | B2 * | 4/2008 | Hart et al. | 347/47 |
| 2004/0100535 | A1 | 5/2004 | Song et al. | |
| 2005/0035999 | A1 | 2/2005 | Kitahara et al. | |

FOREIGN PATENT DOCUMENTS

| | | |
|---|---|---|
| JP | 64018651 | 1/1989 |
| JP | 08118657 A | 5/1996 |

* cited by examiner

*Primary Examiner* — Juanita D Stephens

(57) ABSTRACT

An improved photoimaged nozzle plate for a micro-fluid ejection head, a micro-fluid ejection head containing the nozzle plate, and methods for making a micro-fluid ejection head. The improved nozzle plate is provided by a photoresist nozzle plate layer applied to a thick film layer on a semiconductor substrate containing fluid ejector actuators. The photoresist nozzle plate layer has a plurality of nozzle holes therein. Each of the nozzle holes are formed in the nozzle plate layer from an exit surface of the nozzle plate layer to an entrance surface of the nozzle plate layer. Each of the nozzle holes has a reentrant hole profile with a wall angle greater than about 4° up to about 30° measured from an axis orthogonal to a plane defined by the exit surface of the nozzle plate layer.

6 Claims, 8 Drawing Sheets

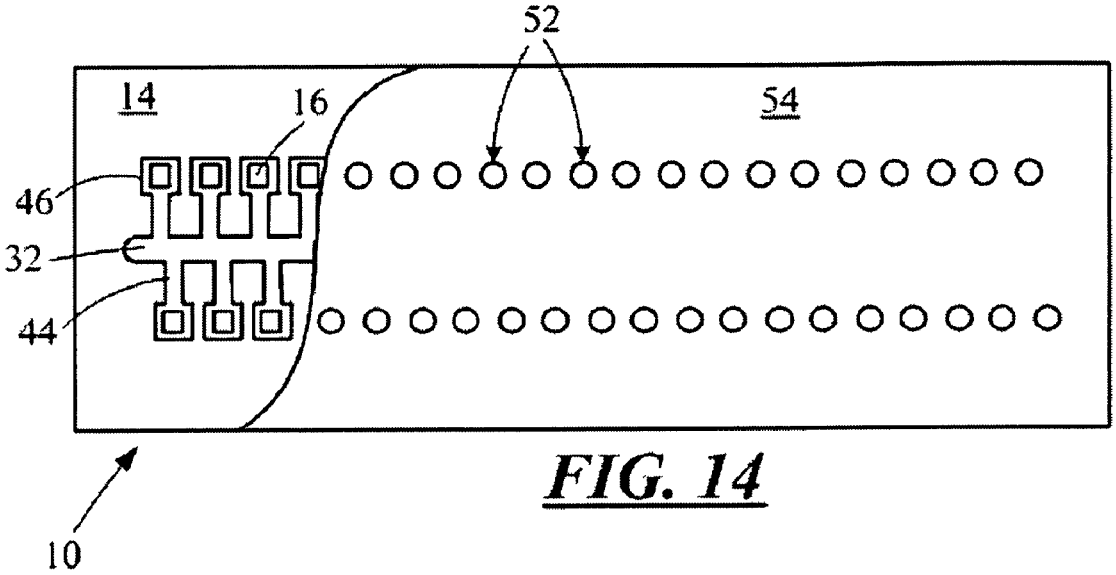
FIG. 14
FIG. 15
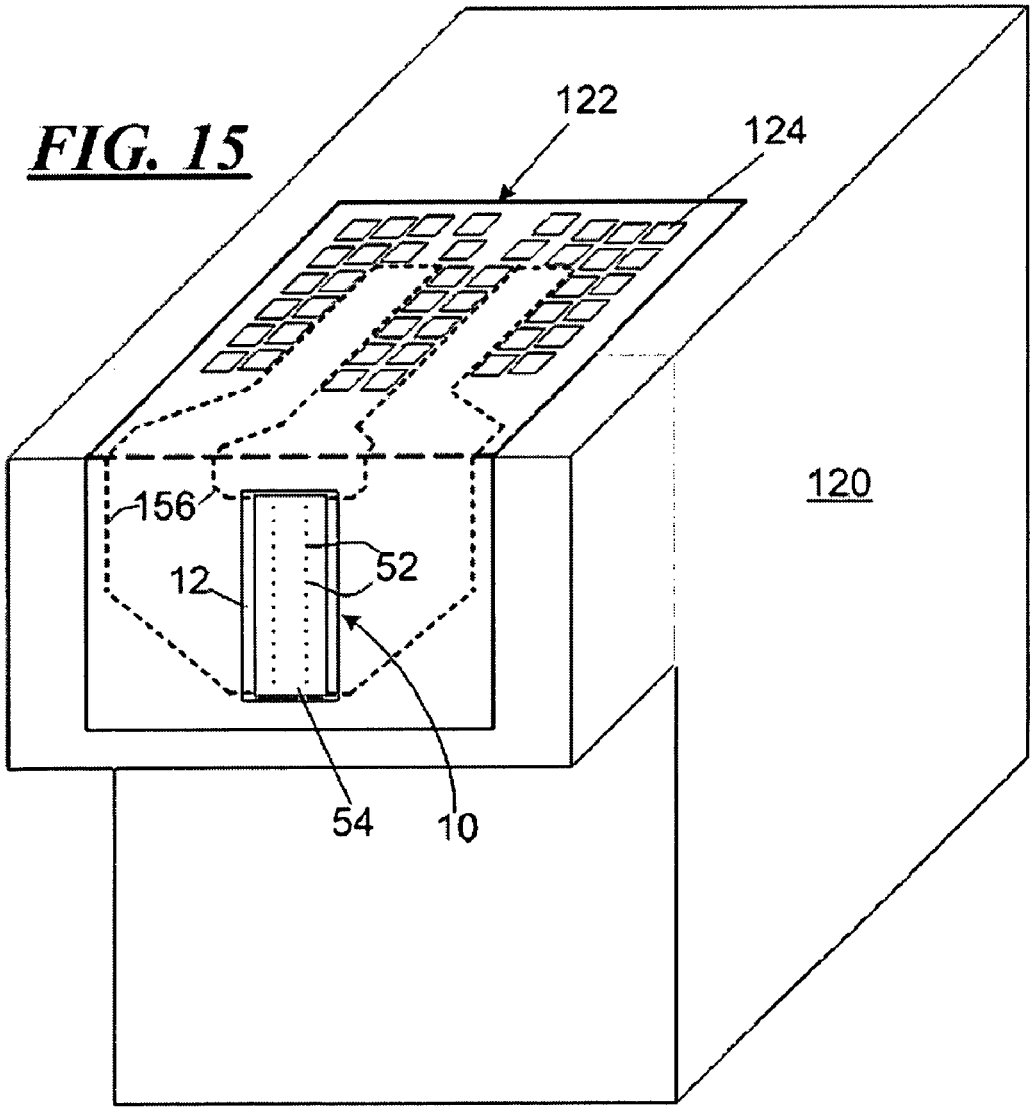

NOZZLE MEMBERS, COMPOSITIONS, AND METHODS FOR MICRO-FLUID EJECTION HEADS

This application is a division of Application Ser. No. 11/239,799, filed Sep. 30, 2005, entitled "Nozzle Members, Compositions and Methods for Micro-fluid Ejection Heads," now U.S. Pat. No. 7,364,268.

FIELD

The disclosure relates to improved nozzle members for micro-fluid ejection heads, and in particular embodiments to methods and compositions for forming reentrant nozzles in photoimageable materials.

BACKGROUND AND SUMMARY

Micro-fluid ejection devices, such as ink jet printers continue to evolve as the technology for ink jet printing continues to improve to provide higher speed, higher quality printers. However, the improvement in speed and quality does not come without a price. The micro-fluid ejection heads are more costly to manufacture because of tighter alignment tolerances.

For example, some conventional micro-fluid ejection heads are made with nozzle members (e.g., nozzle plates) containing flow features. The nozzle plates are then aligned and adhesively attached to a semiconductor substrate. However, minor imperfections in the substrate or nozzle plate components of the ejection head or improper alignment of the parts has a significant impact on the performance of the ejection heads.

One advance in providing improved micro-fluid ejection heads is the use of a photoresist layer applied to a device surface of the semiconductor substrate as a thick film layer. The thick film layer is imaged to provide flow features for the micro-fluid ejection heads. Use of the imaged thick film layer enables more accurate alignment between the flow features and ejection actuators on the device surface of the substrate.

While the use of an imaged photoresist layer improves alignment of the flow features to the ejection actuators, there still exist alignment problems and difficulties associated with a nozzle member attached to the thick film layer and the ability to provide suitable nozzles (e.g., holes) in the nozzle layer after it is attached to the thick film layer. In order for micro-fluid ejection heads to provide precise ejection of fluid droplets, the nozzles in the nozzle layer should have a reentrant profile. There is less flow restriction with reentrant nozzles and thus less energy required to eject fluid droplets. The term "reentrant" is used to refer to side wall profiles of the nozzles, wherein exit diameters of the nozzles are smaller than entrance diameters of the nozzles. so that the side walls of the nozzles are not perpendicular to a plane defined by an exit surface of the nozzle member.

Conventional nozzle plates are typically made from metal that is electroformed or a polyimide material that is laser ablated and then adhesively attached to the thick film layer. The formation of exit hole diameters smaller than entrance hole diameters is achieved in conventional nozzle plates by forming the holes from an entrance side of the nozzle plate. However, use of such nozzle plates requires an alignment step to attach the nozzle plate to the thick film layer and to align the nozzles with the flow features in the thick film layer and with the fluid ejector actuators.

In order to eliminate such alignment steps, photoimageable nozzle materials may be applied adjacent (e.g., to) the thick film layer by spin coating or lamination techniques. Such spin coating techniques and lamination techniques are done before the nozzles are formed in the nozzle material. Nozzles must then be formed from an exit side of the nozzle material. Conventional photoimaging and developing techniques do not provide suitable reentrant nozzles. For example, conventional photoimaging and developing techniques cannot readily provide nozzles having wall angles of greater than about 4°. Typically, such conventional techniques provide vertical walled nozzles or nozzles having an exit diameter larger than an entrance diameter. For the purposes of this disclosure the term "diameter" is used for simplicity in describing the dimensions of nozzles. However, the term "diameter is not limited to the dimension of circular holes as the nozzles may have other shapes, such as ellipses, stars, etc.

Accordingly, there is a need for, among other things, improved photoresist or photoimageable materials that may be used as nozzle materials and improved techniques for forming reentrant nozzles in such. nozzle materials.

In some of the exemplary embodiments of the present invention, there is provided, for example, improved photoimaged nozzle members for a micro-fluid ejection heads, micro-fluid ejection heads containing such nozzle members, and methods for making the same. In one embodiment, a photoresist nozzle layer is applied adjacent a thick film layer on a substrate having fluid ejector actuators. The photoresist nozzle layer has a plurality of nozzles therein. The nozzles are formed in the nozzle layer from an exit surface of the nozzle layer to an entrance surface of the nozzle layer. The nozzles have a reentrant profile with a wall angle greater than about 4° up to about 30° measured from an axis orthogonal to a plane defined by the exit surface of the nozzle layer.

In another embodiment, there is provided a method for making a micro-fluid ejection head. The method includes applying a negative photoresist nozzle layer adjacent a thick film layer on a substrate having a plurality of micro fluid ejection actuators. The nozzle layer has a thickness ranging from about 10 to about 30 microns. A plurality of nozzles are imaged in the nozzle layer from an exit surface of the nozzle layer to an entrance surface of the nozzle layer using a mask. The imaged nozzle layer is developed to provide nozzles having reentrant profiles with wall angles greater than about 4° up to about 30° measured from an axis orthogonal to a plane defined by the exit surface of the nozzle layer.

An advantage of at least certain of the exemplary embodiments described herein is that nozzles may be made in a photoimageable material from an exit side thereof while still providing nozzles having improved fluid flow characteristics. The terms "exit side" and "exit surface" refer to a side or surface of the nozzle member that is opposite to a surface or side that is attached adjacent to a thick film layer on a substrate. In particular, the compositions and methods described herein may enable the formation of reentrant nozzles in a photoimageable nozzle material after the nozzle material is applied adjacent a thick film layer on a substrate. Hence, alignment problems associated with aligning a nozzle material to fluid ejection actuators and flow features on a substrate can be substantially reduced. Unlike conventional photoimaging methods, the compositions and methods described herein enable the formation of nozzles with wall angles greater than about 4°.

For purposes of the disclosure, "difunctional epoxy" means epoxy compounds and materials having only two epoxy functional groups in the molecule. "Multifunctional epoxy" means epoxy compounds and materials having more than two epoxy functional groups in the molecule.

BRIEF DESCRIPTION OF THE DRAWINGS

Further advantages of the exemplary embodiments will become apparent by reference to the detailed description when considered in conjunction with the figures, which are not to scale, wherein like reference numbers indicate like elements through the several views, and wherein:

FIG. 14 is a plan view, not to scale, of a nozzle member made according to the disclosure attached to a thick film layer and semiconductor substrate providing a micro-fluid ejection head;

FIG. 15 is a perspective view of a fluid reservoir containing a micro-fluid ejection head made according to the disclosure.

DETAILED DESCRIPTION OF EXEMPLARY EMBODIMENTS

Figure 1:
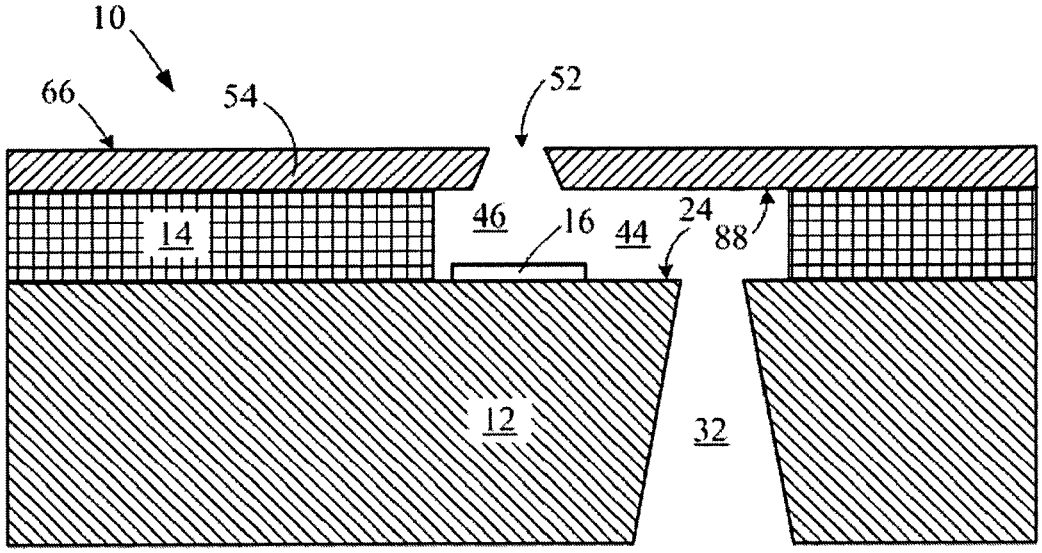
FIG. 1 is a cross-sectional view, not to scale, of a portion of a micro-fluid ejection head according to the disclosure.

With reference to FIG. 1, there is shown, in partial cross-sectional view, a portion of a micro-fluid ejection head 10. The micro-fluid ejection head 10 includes a thick film layer 14 attached to a substrate, such as semiconductor substrate 12 having various insulative, conductive, resistive, and passivating layers providing a fluid ejector actuator 16.

Figure 2:
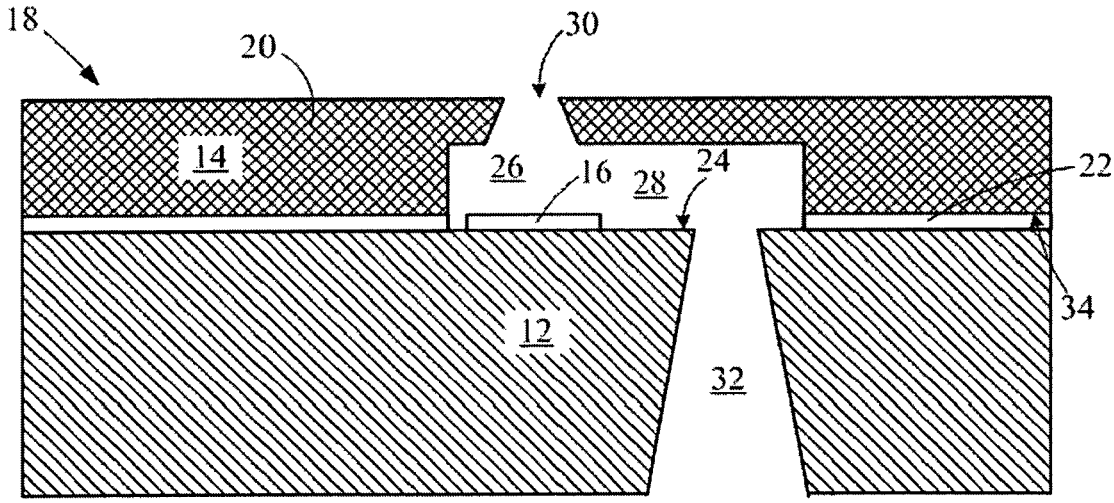
FIG. 2 Prior Art
FIGS. 2-4 are cross-sectional views, not to scale, of portion of prior art micro-fluid ejection heads.

FIG. 2 depicts a prior art micro-fluid ejection head. 18, wherein a nozzle member, such as nozzle plate 20, is attached as by an adhesive 22 to a device surface 24 of the semiconductor substrate 12. In such a micro-fluid ejection head 18, the nozzle plate 20 is made out of a laser ablated material such as polyimide. The polyimide material is laser ablated to provide a fluid chamber 26 in fluid flow communication with a fluid supply channel 28. Upon activation of the ejector actuator 16, fluid is expelled through a nozzle 30 that is also laser ablated in the polyimide material of the nozzle plate 20. The fluid chamber 26 and fluid supply channel 28 are collectively referred to as "flow features." A fluid feed slot 32 is etched in the substrate 12 to provide fluid via the fluid supply channel 28 to the fluid chamber 26 and ejection actuator 16.

In order to provide the laser ablated nozzle plate 20, the polyimide material is laser ablated from a flow feature side 34 thereof before the nozzle plate 20 is attached to the semiconductor substrate 12. Accordingly, misalignment between the flow features in the nozzle plate 20 and the fluid ejector actuator 16 may be detrimental to the functioning of the micro-fluid ejection head 10. For alignment purposes, it is more effective to form the nozzle holes in a nozzle plate after the nozzle plate is attached to the substrate.

Figure 3:
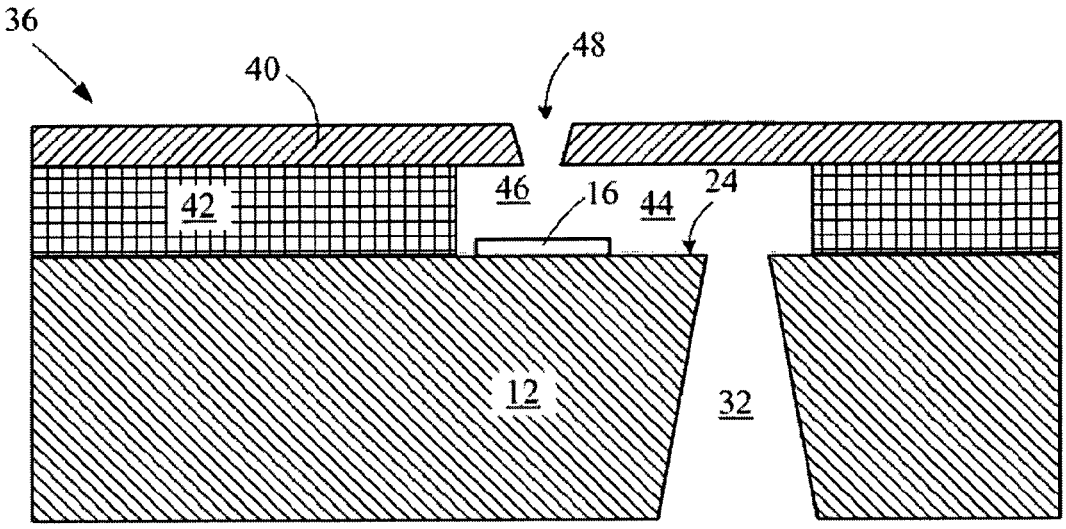
FIG. 3 Prior Art
Figure 4:
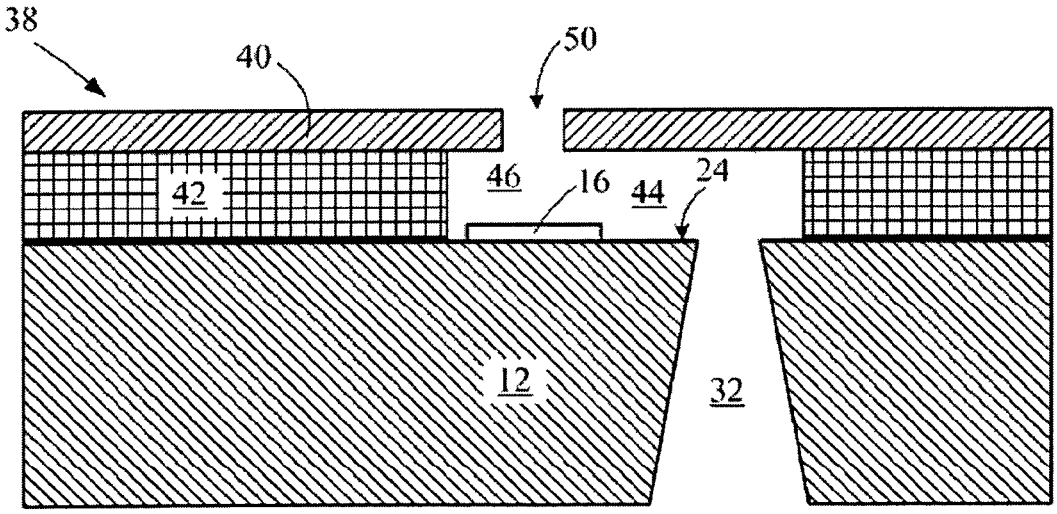
FIG. 4 Prior Art

Prior art micro-fluid ejection heads 36 and 38 having nozzles formed in a nozzle plate 40 after the nozzle plate is attached to a thick film layer 42 are illustrated in FIGS. 3 and 4, respectively. In these prior art micro-fluid ejection heads 36 and 38, the thick film layer 42 provides the flow features, i.e., a fluid supply channel 44 and a fluid chamber 46 for providing fluid to the fluid ejector actuator 16. In such ejection heads 36 and 38, the thick film layer 42 is a photoresist material that is spin coated onto the device surface 24 of the substrate 12. The photoresist material is then imaged and developed using conventional photoimaging techniques to provide the flow features.

The separate nozzle plate 40 material is attached to the thick film layer 42 as by roll lamination, thermal compression bonding or by use of an adhesive. The nozzle plate 40 is then imaged and developed to provide nozzles 48 and 50. As in FIG. 1, the nozzle plate 40 may be made of a photoresist material. However, as shown in FIGS. 3 and 4, conventional photoimaging techniques used to form nozzles 48 and 50 after the nozzle plate 40 is attached to the thick film layer 42 lead to nozzles 48 having a larger exit diameter than entrance diameter or nozzles 50 having substantially vertical walls. Compared to nozzles 52 (FIG. 1) in nozzle member 54 having a reentrant profile, the nozzles 48 or 50 provide less effective flow characteristics for a micro-fluid ejection bead.

Figure 5:
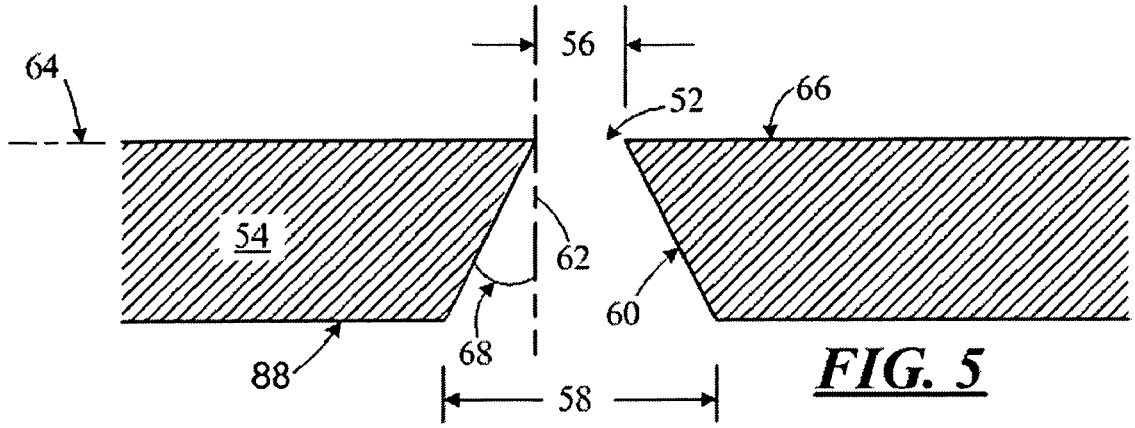
FIG. 5 is a cross-sectional view, not to scale of a portion of a nozzle member made according to the disclosure showing a reentrant nozzle formed therein.
Figure 6:
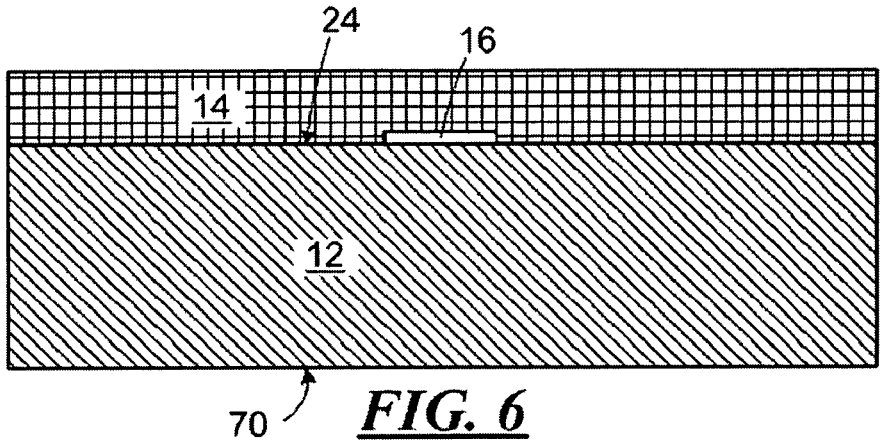
FIGS. 6-7 are cross-sectional views, not to scale, illustrating a method for forming flow features in a thick film layer attached to a semiconductor substrate.

An enlarged view of a portion of the nozzle member 54 showing nozzle 52 is illustrated in FIG. 5. As set forth above, the nozzle 52 preferably has a reentrant profile so that an exit diameter 56 is smaller than an entrance diameter 58. Side walls 60 of the nozzle 52 are angled with respect to an axis 62 that is orthogonal to a plane 64 defined by exit surface 66 of the nozzle member 54. Accordingly, the side walls 60 of the nozzle 52 form an angle 68 that ranges from above about 4° to about 30° with respect to the axis 62. Conventional prior art methods are not suitable for forming such angles 68 in nozzle members 54 having a thickness ranging from about 10 to about 20 microns.

Methods for making micro-fluid ejection heads, such as the head 10 will now be described with reference to FIGS. 6-13. In a first step, illustrated in FIG. 6, a photoresist material is applied adjacent (e.g., to) the device surface 24 of the substrate 12 to provide a thick film layer 14. A suitable photoresist formulation for providing thick film layer 14 (FIG. 6) includes a multi-functional epoxy compound, a first di-functional epoxy compound, a photoacid generator, and, optionally, an adhesion enhancing agent. A suitable multifunctional epoxy component may be selected from aromatic epoxides such as glycidyl ethers of polyphenols. An exemplary multifunctional epoxy resin is a polyglycidyl ether of a phenol-formaldehyde novolac resin, such as a novolac epoxy resin having an epoxide gram equivalent weight ranging from about 190 to about 250, and a viscosity at 130° C. ranging from about 10 to about 60 poise, which is available from Resolution Performance Products of Houston, Tex. under the trade name EPON RESIN SU-8.

The multi-functional epoxy component of the photoresist formulation may have a weight average molecular weight of about 3,000 to about 5,000 Daltons as determined by gel permeation chromatography, and an average epoxide group functionality of greater than 3, such as from about 6 to about 10. The amount of multifunctional epoxy resin in the photoresist formulation for the thick film layer 14 may range from about 30 to about 50 percent by weight based on the weight of the cured thick film layer 14.

A second component of the photoresist formulation for the thick film layer 14 is the first di-functional epoxy compound. The first di-functional epoxy component may be selected from di-functional epoxy compounds which include diglycidyl ethers of bisphenol-A (e.g. those available under the trade designations "EPON 1007F", "EPON pb 1007" and "EPON 1009F", available from Shell Chemical Company of Houston, Tex., "DER-331", "DER-332", and "DER-334", available from Dow Chemical Company of Midland, Mich., 3,4-epoxycyclohexylmethyl-3,4-epoxycyclo-hexene carboxylate (e.g. "ERL-4221" available from Union Carbide Corporation of Danbury, Conn., 3,4-epoxy-6-methylcyclohexylmethyl-3,4-epoxy-6-methylcy-clohexene carboxylate (e.g. "ERL-4201" available from Union Carbide Corporation), bis(3,4-epoxy-6-methylcyclohexylmethyl) adipate (e.g. "ERL-4289" available from Union Carbide Corporation), aid bis(2,3-epoxycyclopentyl) ether (e.g. "ERL-0400" available from Union Carbide Corporation.

An exemplary first di-functional epoxy component is a bisphenol-A/epichlorohydrin epoxy resin available from Shell Chemical Company of Houston, Tex. under the trade name EPON resin 1007F having an epoxide equivalent of greater than about 1000. An "epoxide equivalent" is the number of grams of resin containing 1 gran-equivalent of epoxide. The weight average molecular weight of the first di-functional epoxy component is typically above 2500 Daltons, e.g., from about 2800 to about 3500 weight average molecular weight. The amount of the first di-functional epoxy component in the thick film photoresist formulation may range from about 30 to about 50 percent by weight based on the weight of the cured resin.

The photoresist formulation for the thick film layer 14 also includes a photoacid generator devoid of aryl sulfonium salts. The photoacid generator can be a compound or mixture of compounds capable of generating a cation such as an aromatic complex salt which may be selected from onium salts of a Group VA element, onium salts of a Group VIA element, and aromatic haloniun salts. Aromatic complex salts, upon being exposed to ultraviolet radiation or electron beam irradiation, are capable of generating acid moieties which initiate reactions with epoxides. The photoacid generator may be present in the photoresist formulation for the thick film layer 14 in an amount ranging from about 5 to about 15 weight percent based on the weight of the cured resin.

Of the aromatic complex salts which are suitable for use in exemplary photoresist formulation disclosed herein, suitable salts are di- and triaryl-substituted iodonium salts. Examples of aryl-substituted iodonium complex salt photoacid generates include, but are not limited to:

diphenyliodonium trifluoromethanesulfonate, (p-tert-butoxyphenyl)phenyliodonium trifluoromethanesulfonate, diphenyliodonium p-toluenesulfonate, (p-tert-butoxyphenyl)-phenyliodonim p-toluenesulfonate, bis(4-tert-butylphenyl)iodonium hexafluorophosphate, and diphenyliodonium hexafluoroantimonate.

An exemplary iodonium salt for use as a photoacid generator for the embodiments described herein is a mixture of diaryliodonium hexafluoroantimonate salts, commercially available from Sartomer Company, Inc. of Exton, Pa. under the trade name SARCAT CD 1012

The photoresist formulation for the thick film layer 14 may optionally include an effective amount of an adhesion enhancing agent such as a silane compound. Silane compounds that are compatible with the components of the photoresist formulation typically have a functional group capable of reacting with at least one member selected from the group consisting of the multifunctional epoxy compound, the difunctional epoxy compound and the photoinitiator. Such an adhesion enhancing agent may be a silane with an epoxide functional group such as a glycidoxyalkyltrialkoxysilane, e.g., gamma-glycidoxypropyltrimethoxysilane. When used, the adhesion enhancing agent can be present in an amount ranging from about 0.5 to about 2 weight percent, such as from about 1.0 to about 1.5 weight percent based on total weight of the cured resin, including all ranges subsumed therein. Adhesion enhancing agents, as used herein, are defined to mean organic materials soluble in the photoresist composition which assist the film forming and adhesion characteristics of the thick film layer 14 on the device surface 24 of the substrate 12.

In order to provide the thick film layer 14 adjacent the device surface 24 of the substrate 12 (FIG. 6), a suitable solvent can be used. A suitable solvent includes a solvent, such as one which is non-photoreactive. Non-photoreactive solvents include, but are not limited to gamma-butyrolactone, $C_{1-6}$ acetates, tetrahydrofuran, low molecular weight ketones, mixtures thereof and the like. An exemplary non-photoreactive solvent is acetophenone. The non-photoreactive solvent is present in the formulation mixture used to provide the thick film layer 14 in an amount ranging of from about 20 to about 90 weight percent, such as from about 40 to about 60 weight percent, based on the total weight of the photoresist formulation. In an exemplary embodiment, the non-photoreactive solvent does not remain in the cured thick film layer 14 and is thus removed prior to or during the thick film layer 14 curing steps.

According to an exemplary procedure, the non-photoreactive solvent and first di-functional epoxy compound are mixed together in a suitable container such as an amber bottle or flask and the mixture is put in a roller mill overnight at about 60° C. to assure suitable mixing of the components. After mixing the solvent and the di-functional epoxy compound, the multi-functional epoxy compound is added to the container and the resulting mixture is rolled for two hours on a roller mill at about 60° C. The other components, the photoacid generator and the adhesion enhancing agent, are also added one at a time to the container and the container is rolled for about two hours at about 60° C. after adding all of the components to the container to provide a wafer coating mixture.

In order to apply the photoresist thick film layer 14 adjacent the device surface 24 of tie substrate (FIG. 6), a silicon substrate wafer is centered on an appropriate sized chuck of either a resist spinner or conventional wafer resist deposition track. A suitable photoresist formulation mixture is either dispensed by hand or mechanically into the center of the wafer. The chuck holding the wafer is then rotated at a predetermined number of revolutions per minute to evenly spread the mixture from the center of the wafer to the edge of the wafer. The rotational speed of the wafer may be adjusted or the viscosity of the coating mixture may be altered to vary the resulting resin film thickness. Rotational speeds of 2500 rpm or more may be used. The amount of photoresist formulation applied adjacent device surface 24 should be sufficient to provide the thick film layer 14 having the desired thickness for flow features imaged therein. Accordingly, the thickness of the thick film layer 14 after curing may range from about 10 to about 25 microns or more.

The resulting silicon substrate wafer containing the thick film layer 14 is then removed from the chuck either manually or mechanically and placed on either a temperature controlled hotplate or in a temperature controlled oven at a temperature of about 90° C. for about 30 seconds to about 1 minute until the material is "soft" baked. This step removes at least a portion of the solvent from the thick film layer 14 resulting in a partially dried film on the device surface 24 of the substrate 12. The wafer is removed from the heat source and allowed to coot to room temperature.

The flow features are then imaged and developed in the thick film layer 14. In order to define flow features in the thick film layer 14, such as the fluid chamber 46 and fluid supply channel 44, the layer 14 is imaged through a mask 72 containing opaque areas 74 and transparent areas 76. Areas of the thick film layer 14 (i.e., a negative acting photoresist layer 14) masked by opaque areas 74 of the mask 72 will be removed upon developing to provide the flow features described above.

Figure 7:
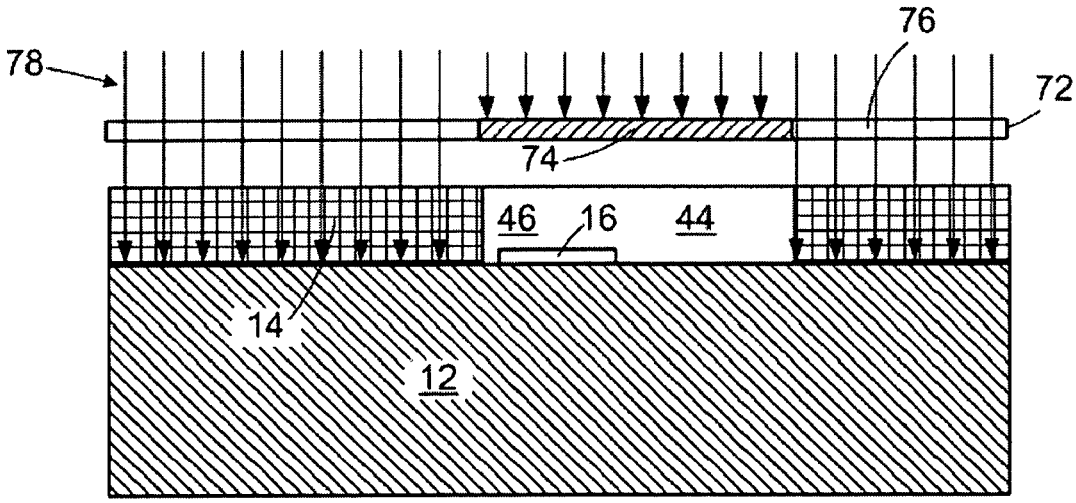

FIG. 7, a radiation source provides actinic radiation indicated by arrows 78 to image the thick film layer 14. A suitable source of radiation emits actinic radiation at a wavelength within the ultraviolet and visible spectral regions. Exposure of the thick film layer 14 to the actinic radiation may be from less than about 1 second to 10 minutes or more, such as from about 5 seconds to about one minute, depending upon the particular photoresist formulation used for the thick film layer 14, the radiation source, distance from the radiation source, and the thickness of the thick film layer 14. The thick film layer 14 may optionally be exposed to electron beam irradiation instead of ultraviolet radiation.

The foregoing procedure is similar to a standard semiconductor lithographic process. The mask 72 is a clear, flat substrate usually glass or quartz with the opaque areas 74 defining the areas to be removed from the layer 14 (i.e. a negative acting photoresist layer 14). The opaque areas 74 prevent the ultraviolet light from cross-linking the layer 14 masked beneath it. The exposed areas of the layer 14 provided by the substantially transparent areas 76 of the mask 72 are subsequently baked at a temperature of about 90° C. for about 30 seconds to about 10 minutes, such as from about 1 to about 5 minutes to complete the curing of the thick film layer 14.

Figure 8:
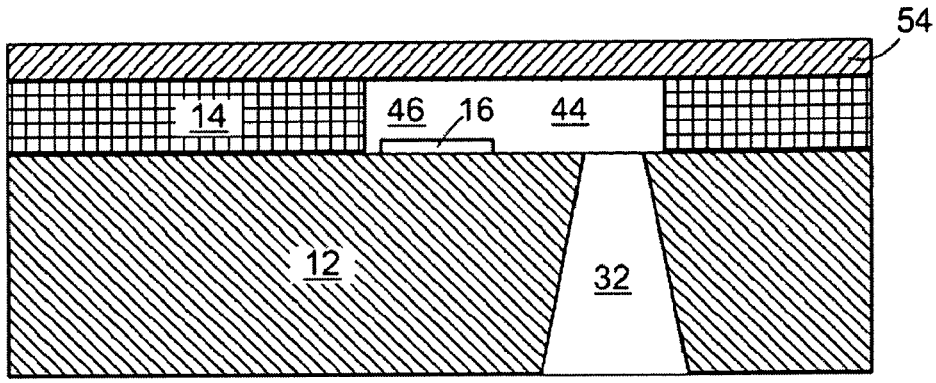
FIGS. 8-11 are schematic views of processes for imaging a nozzle member according to embodiments of the disclosure.

The non-imaged or masked areas of the thick film layer 14 are then solubilized by a developer and the solubilized material is removed leaving the imaged and developed thick film layer 14 on the device surface 24 of the substrate 12 as shown in FIG. 8. The developer comes into contact with the substrate 12 and the imaged thick film layer 14 through either immersion and agitation in a tank-like setup or by spraying the developer on the substrate 12 and thick film layer 14. Either spray or immersion will adequately remove the non-imaged material. Illustrative developers include, for example, butyl cellosolve acetate, a xylene and butyl cellosolve acetate mixture, and $C_{1-6}$ acetates like butyl acetate.

The fluid supply slot 32 can be formed through substrate 12 from a fluid supply side 70 to the device surface side 24 as shown in FIG. 8. Methods for forming fluid supply slots, such as slot 32, include deep reactive ion etching, grit blasting, chemical etching and the like. In the alternative, the fluid supply slot 32 may be formed before imaging and developing the thick film layer 14.

With reference to FIG. 8, after imaging and developing the thick film layer 14 and forming the fluid supply slot 32, a second photoresist layer is laminated adjacent the thick film layer 14 to provide nozzle member 54. The second photoresist layer may be provided by a dry film photoresist material derived from a di-functional epoxy compound, a relatively high molecular weight polylhydroxy ether, the photoacid generator described above, and, optionally, the adhesion enhancing agent described above.

The di-functional epoxy compound used for providing the nozzle member 54, includes the first di-functional epoxy compound described above, having a weight average molecular weight typically above 2500 Daltons, e.g., from about 2800 to about 3500 weight average molecular weight in Daltons.

In order to enhance the flexibility of the nozzle member 54 for lamination purposes, for example, a second di-functional epoxy compound may be included in the formulation for the second photoresist layer. The second di-functional epoxy compound typically has a weight average molecular weight of less than the weight average molecular weight of the first di-functional epoxy compound. In particular, the weight average molecular weight of the second di-functional epoxy compound ranges from about 250 to about 400 Daltons. Substantially equal parts of the first di-functional epoxy compound and the second di-functional epoxy compound are used to make the nozzle member 54. A suitable second di-functional epoxy compound may be selected from diglycidyl ethers of bisphenol-A available from DIC Epoxy Company of Japan under the trade name DIC 850-CRP and from Shell Chemical of Houston, Tex. under the trade name EPON 828. The total amount of di-functional epoxy compound in the nozzle layer 54 ranges from about 40 to about 60 percent by weight based on the total weight of the cured nozzle member 54. Of the total amount of di-functional epoxy compound in the nozzle member 54, about half of the total amount is the first di-functional epoxy compound and about half of the total amount is the second di-functional epoxy compound.

Another component of the second photoresist composition is a relatively high molecular weight polyhydroxy ether compound of the formula:

$$[OC_6H_4C(CH_3)_2C_6H_4OCH_2CH(OH)CH_2]_n$$

having terminal alpha-glycol groups, wherein n is an integer from about 35 to about 100. Such compounds are made from the same raw materials as epoxy resins, but contain no epoxy groups in the compounds. Such compounds are often referred to as phenoxy resins. Examples of suitable relatively high molecular weight phenoxy resins include, but are not limited to, phenoxy resins available from InChem Corporation of Rock Hill, S.C. under the trade names PKHP-200 and PKHJ. Such phenoxy compounds have a solids content of about 99 weight percent, a Brookfield viscosity at 25° C. ranging from about 450 to about 800 centipoise, a weight average molecular weight in Daltons ranging from about 50,000 to about 60,000, a specific gravity, fused at 25° C., of about 1.18, and a glass transition temperature of from about 90° to about 95° C. The nozzle member 54 contains from about 25 to about 35 percent by weight phenoxy resin based on the weight of the cured nozzle member 54.

As with the photoresist material for the thick film layer 14, the second photoresist composition for the nozzle member 54 includes the photoacid generator described above, and, optionally, the adhesion enhancing agent described above. The amount of the photoacid generator ranges from about 15 to about 20 by weight based on the weight of the cured nozzle member 54. The amount of adhesion enhancing agent, when used, ranges from about 0.05 to about 1 percent by weight based on the weight of the cured nozzle member 54.

As set forth above, the nozzle member 54 is applied as a dry film laminate adjacent the thick film layer 14. Accordingly, the foregoing components of the second photoresist composition used to provide the nozzle member 54 may be dissolved in a suitable solvent or mixture of solvents and dried on a release liner or other suitable support material. A solvent in which all of the components of the second photoresist composition are soluble is an aliphatic ketone solvent or mixture of solvents. A particularly useful aliphatic ketone solvent is cyclohexanone. Cyclohexanone may be used alone or, as in an exemplary embodiment, in combination with acetone. Cyclohexanone is used as the primary solvent for the second photoresist composition due to the solubility of the high molecular weight phenoxy resin in cyclohexanone. Acetone is optionally used as a solvent to aid the film formation process. Since acetone is highly volatile solvent it eludes off quickly after the film has been drawn down onto a release liner or support material. Volatilization of the acetone helps solidify the liquid resin into a dry film.

A suitable photoresist formulation for providing the nozzle material 54 is as follows:

TABLE 1

| Component | Amount in photoresist formulation (wt. %) |
|---|---|
| First di-functional epoxy component (EPON 1007F) | 9.6 |
| Second di-functional epoxy component (DIC 850 CRP) | 9.6 |
| Polyhydroxy ether (InChem PKHJ) | 12.8 |
| Diaryliodoniumhexafluoroantimonate (SARCAT 1012) | 7.2 |
| Glycidoxypropyltrimethoxysilane (Z-6040) | 0.3 |
| Cyclohexanone | 50 |
| Acetone | 10.5 |

Figure 9:
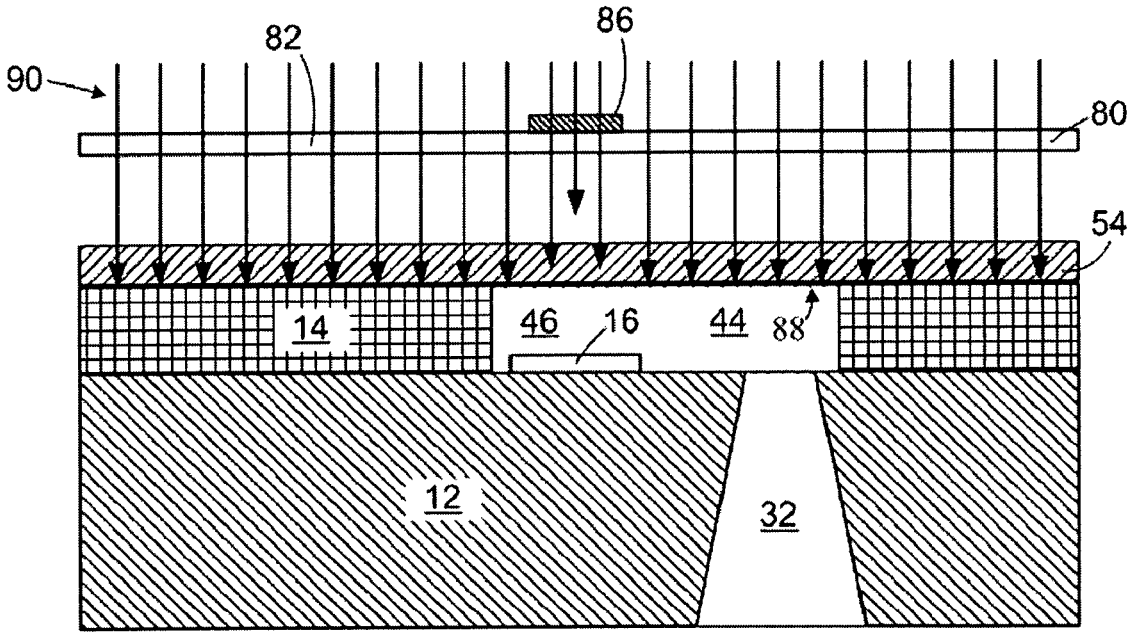
Figure 13:
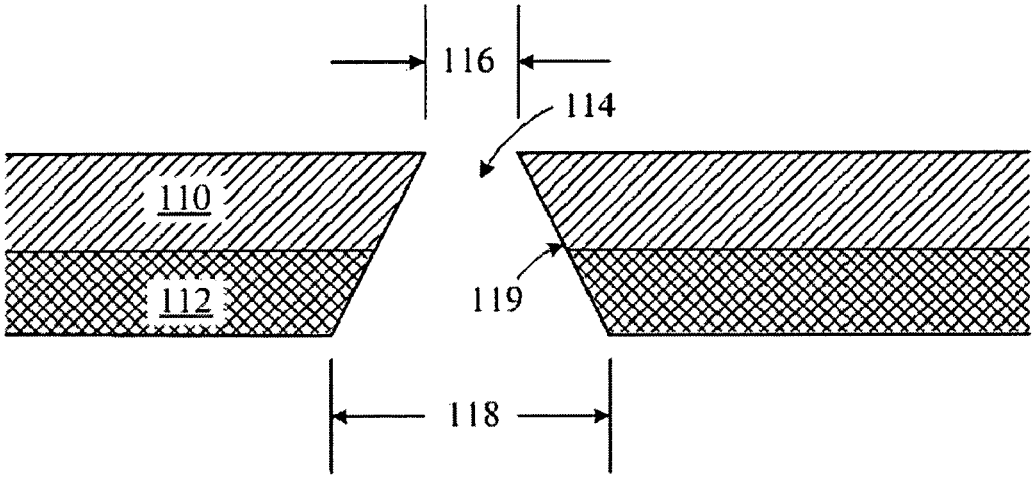
FIG. 13 is a cross-sectional view, not to scale, of a portion of the nozzle member of FIG. 12 showing a reentrant nozzle formed therein.

With reference to FIGS. 9 and 13, alternative methods for imaging the nozzle member 54 to provide reentrant nozzles will now be described, such as wherein a mask is used to define the nozzles in the nozzle member 54. In FIG. 9, a mask 80 having transparent areas 82 and an area containing a focus altering coating 86 is used to define the nozzles such as nozzle 52 (FIG. 1) in the nozzle member 54. The focus altering coating 86 attenuates the actinic radiation so that more cross-linking of the photoresist material occurs adjacent the exit surface of the nozzle member 54 and the radiation effective for cross-linking is reduced as the radiation travels through the nozzle member 54 to a surface 88 adjacent the thick film layer 14 as indicated by arrows 90. The remainder of the nozzle member 54 is cured by the actinic radiation traveling through the transparent areas 82 of the mask 80. Upon developing the nozzle member 54 with a suitable solvent as described above the reentrant nozzles 52 are formed in the nozzle member 54 as shown in FIG. 1. The focus altering coating may be selected from quartz, sapphire, fused silica, fluorite (such as $CaF_2$ and $MgF_2$), and specialized glasses from Melles Griot of Rochester, N.Y. under the trade names BK7, F2, and BaKl.

Figure 10:
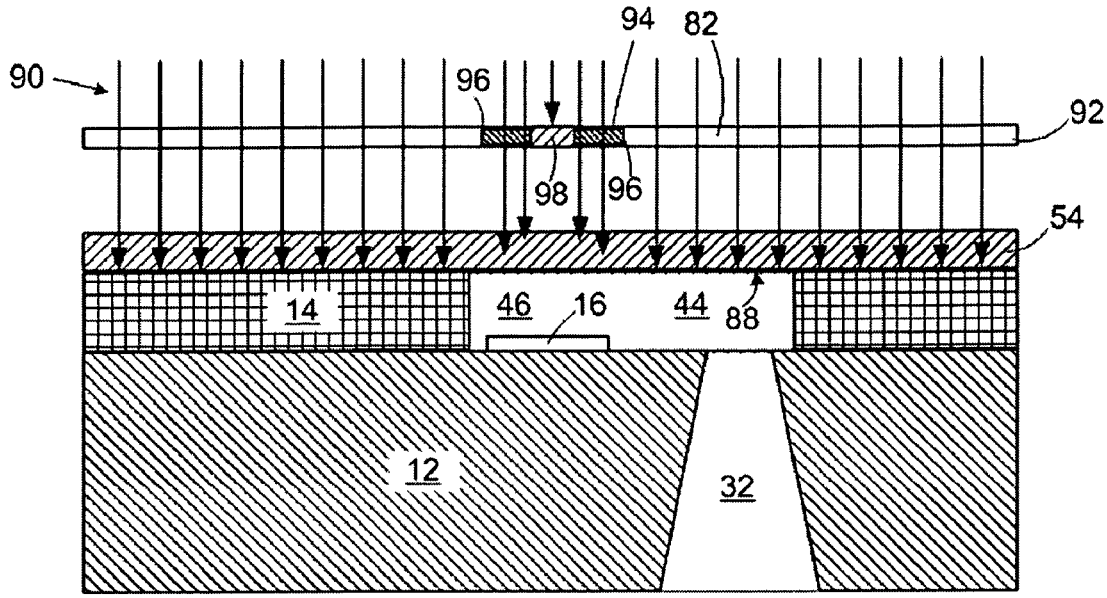

In another embodiment, illustrated in FIG. 10, a gray scale mask 92 is used to form the nozzles 52 having reentrant side walls 60 (FIG. 5). Like the focus altering coating 86, the gray scale mask 92 attenuates the actinic radiation so that more radiation is effective for cross-linking adjacent the exit surface 66 of the nozzle member 54. The amount of radiation is reduced that passes through the nozzle member 54 to the surface 88 adjacent the thick film layer 14 to provide the entrance diameter 58 of the nozzle 52. Gray scale areas 94 of the mask 92 are provided with increasing opacity toward ends 96, while a central portion 98 between the gray scale areas 94 is completely opaque providing the exit diameter 56 of the nozzle 52.

Figure 11:
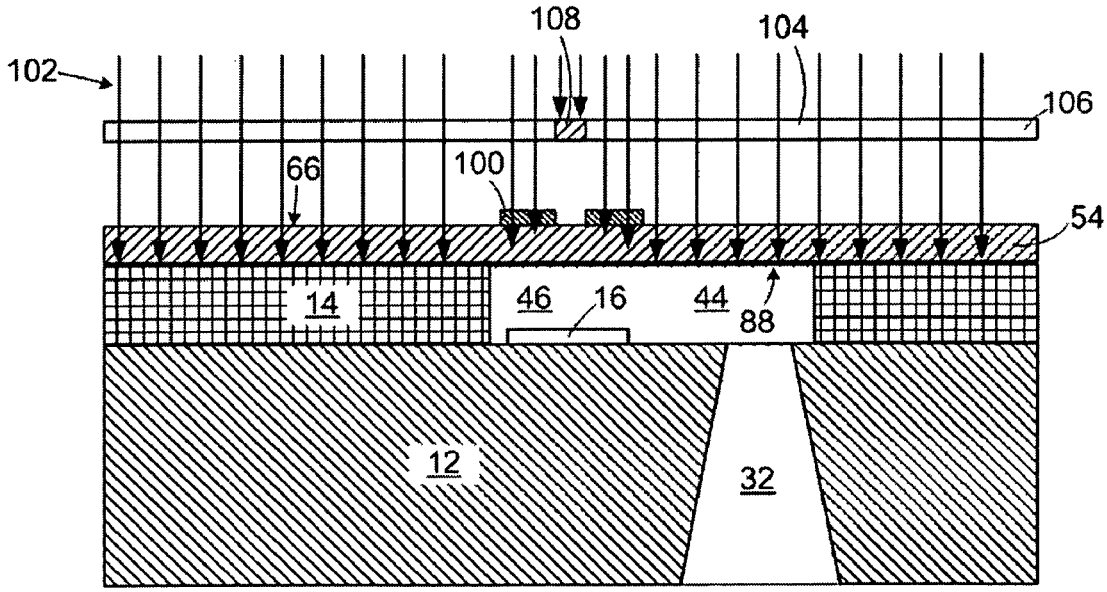

Another alternative method for forming reentrant nozzles 52 in the nozzle member 54 is illustrated in FIG. 11. In this embodiment, a removable focus altering coating 100 is applied to the exit surface 66 of the nozzle member 54. The focus altering coating 100 may be provided by UV transparent polymers such as oriented polyvinylidene fluoride; copolyester ethers and cellulosic plastics available from Eastman Chemical Company of Kingsport, Tenn. under the trade names ECDEL and TENITE respectively; polymethylpentenes available from Mitsui Plastics Inc. of White Plains, N.Y. under the trade name TPX; and fluoropolymers available from E. I. Du Pont De Nemours and Ccompany Corporation of Wilmington, Del. under the trade name TEFLON. Other suitable materials include, but are not limited to, positive photoresist materials and light stabilized polyamide based materials such as the materials available from Allied Signal Incorporated of Morristown, N.J. These materials may act as a lens to change the depth through which the actinic radiation focuses on the nozzle member 54 material. As with the focus altering coating 86, the focus altering coating 100 attenuates the actinic radiation so that more cross-linking of the photoresist material occurs adjacent the exit surface 66 of the nozzle member 54 and the radiation effective for cross-linking is reduced as the radiation travels through the nozzle member 54 to a surface 88 adjacent the thick film layer 14 as indicated by arrows 102. The remainder of the nozzle member 54 is cured by the actinic radiation traveling through transparent areas 104 of a mask 106 containing an opaque area 108 defining the exit diameter 56 of the nozzle 52.

When using the focus, altering coating 86 on the mask 80 or the focus altering coating 100 applied to the nozzle member 54, such coatings 86 and 100 may be selectively patterned for imaging different areas of the nozzle member 54. For examples the nozzles 52 may be formed with reentrant side walls 60 and openings in the nozzle member 54 for contact pad connections to the substrate 12 may be imaged to have substantially vertical side walls. The focus altering coating 100 is removed after imaging the nozzle member in a separate step, or as in one exemplary embodiment, when the nozzles 52 are developed in the nozzle member 54.

Reentrant nozzles 52 in the nozzle member 54 may also be formed by altering the photoresist material used for the nozzle member 54 and imaging the nozzle member 54 with a conventional mask containing opaque and transparent areas. For example, a negative photoresist material for providing the nozzle member 54 may have dispersed therein ultraviolet light absorbing components that alter the cross-linking of the photoresist material as the radiation travels from the exit surface 66 to the surface 88 adjacent the thick film layer 14. Such ultraviolet light absorbing components may be selected from carbon black particles, carbon nanotubes, photoacid generators, other pigments, dyes, and polyetheretherketone. The carbon nanotubes and carbon black particles absorb ultraviolet radiation. As the radiation used to image the nozzle member 54 travels through the nozzle member 54, the radiation is absorbed by the nanotubes or carbon black particles so that less radiation is available for cross-linking toward the thick film surface 88 of the nozzle member 54. Also, the opaque areas of the mask reduce the amount of radiation traveling through the nozzle member adjacent the nozzle 52.

Reducing the amount of photoacid generator in the photoresist material used for the nozzle member 54 reduces the amount of acid available for cross-linking. The photoacid generator absorbs ultraviolet radiation and releases acid in the photoresist material that is used for cross-linking the photoresist material. Typically, photoresist materials contain an excess of the photoacid generator. However, a photoresist material containing from about 0.5 to about 5.0 percent photoacid generator on a weight percent basis may result in areas adjacent the exit surface 66 of the nozzle member 54 cross-linking more than areas adjacent the surface 88 of the nozzle member 54 since the intensity of the radiation decreases as it passes through the nozzle member 54. Areas receiving a higher intensity of radiation generate more acid than areas receiving a lower intensity radiation.

Figure 12:
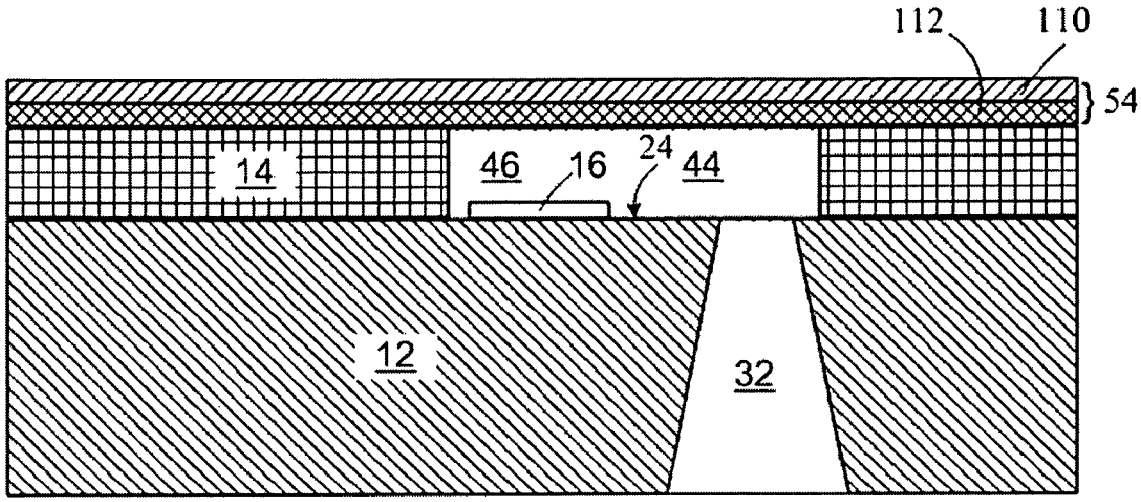
FIG. 12 is a cross-sectional view, not to scale, of a portion of a micro-fluid ejection head containing an alternate nozzle member according to the disclosure.

FIG. 12 illustrates an embodiment for making reentrant nozzles 52 wherein two or more photoresist layers are applied adjacent the thick film layer 14 to provide the nozzle member 54. Each of the photoresist layers contain a light absorbing component dispersed therein. In one embodiment, a first photoresist layer 110 contains more ultraviolet light absorbing components than a second photoresist layer 112. As described above, suitable light absorbing components may be selected from carbon black pigments, carbon nanotubes, polyetheretherketone, photoacid generators, dyes. naphthalene based solvents, polyimide particles, and other pigments that absorb ultraviolet radiation. As with the previously described embodiment, nozzles 114 are imaged in the nozzle member 54 using a conventional mask. Accordingly, due to the presence of different amount of light absorbing components in the layers 110 and 112, more cross-linking will occur in layer 110 than in layer 112 thereby providing a reentrant nozzle 114 as illustrated in FIG. 13. As is shown in FIG. 13, the nozzle 114 has an exit diameter 116 smaller than an inlet diameter 118 and sloping side walls 119.

In another alternative embodiment, a filter may be used with a conventional mask to filter out the peak wavelength of light, for example about 365 nanometer wavelength. The nozzle member 54 is very transparent to a wavelength of 365 nanometers, for example, and less transparent to other wavelengths. Using such a filter, the broad spectrum of light applied to image the nozzle member 54 will not be readily transmitted to lower portions of the nozzle member 54, thereby cross-linking the upper portions of the nozzle member 54 more fully than the lower portions of the nozzle member 54, thereby creating differential cross-linking through the nozzle member 54. Accordingly, upon developing, reentrant nozzles 52 may be formed using such filters.

Additionally, a photoresist material containing a photoinitiator may be used for the nozzle member 54 wherein the photoinitiator in the photoresist material absorbs more ultraviolet light after exposure to ultraviolet radiation than before exposure to ultraviolet radiation. In this embodiment, a pulsed ultraviolet radiation may be used with a conventional mask to expose the nozzle member 54. A short burst of ultraviolet radiation only exposes the upper portions of the nozzle member 54 causing cross-linking reactions to occur in the upper portions of the nozzle member 54 when the ultraviolet radiation is turned off. The photoinitiator exposed to the short burst of radiation may then absorb ultraviolet radiation when a second burst of radiation is applied to the nozzle member thereby decreasing the radiation effective for cross-linking as the radiation travels through the nozzle member 54. By using short burst of radiation, the uppermost portions of the nozzle member 54 are overexposed and the initiator in the uppermost portions causes dark field curing of the nozzle member 54. In this embodiment, the opaque area of the mask would more closely resemble the entrance hole diameter 58 and the exit hole diameter 56 would be smaller than the entrance hole diameter 58 thereby providing the reentrant nozzle 52.

In yet another embodiment a dynamic mask rather than a conventional mask may be used to form the reentrant nozzles 52 in the nozzle member 54. Like the previous embodiment, a dynamic mask having decreasing hole diameters would be used with short bursts of ultraviolet radiation to expose the nozzle member 54. The dynamic mask may include a plurality of masks with different hole sizes or a ultraviolet transparent LCD display wherein a ultraviolet opaque hole diameter is continuously reduced in size from the entrance hole diameter 58 to the exit hole diameter 56 to provide the reentrant nozzle 52. Using this technique, the nozzle 52, measured at intervals from the entrance to the exit side of the nozzle member may not include identical shapes. Such a dynamic mask may be used to provide changing cross-sectional shapes in addition to changing the cross-sectional area of the nozzles from the entrance to the exit side of the nozzles 52. It will be appreciated that one or more of the foregoing embodiments may be combined to provide reentrant nozzles 52.

Subsequent to exposing the nozzle member 54 to ultraviolet radiation., the nozzles 52 are developed using conventional developers as described above. After developing the nozzle member 54, the substrate 12 having the thick film layer 14 and nozzle member 54 is optionally baked at temperature ranging from about 150° C. to about 200° C., such as from about from about 170° C. to about 190° C. for about 30 minutes to about 150 minutes, such as from about 60 to about 120 minutes to post cure the photoresist materials.

Figure 16:
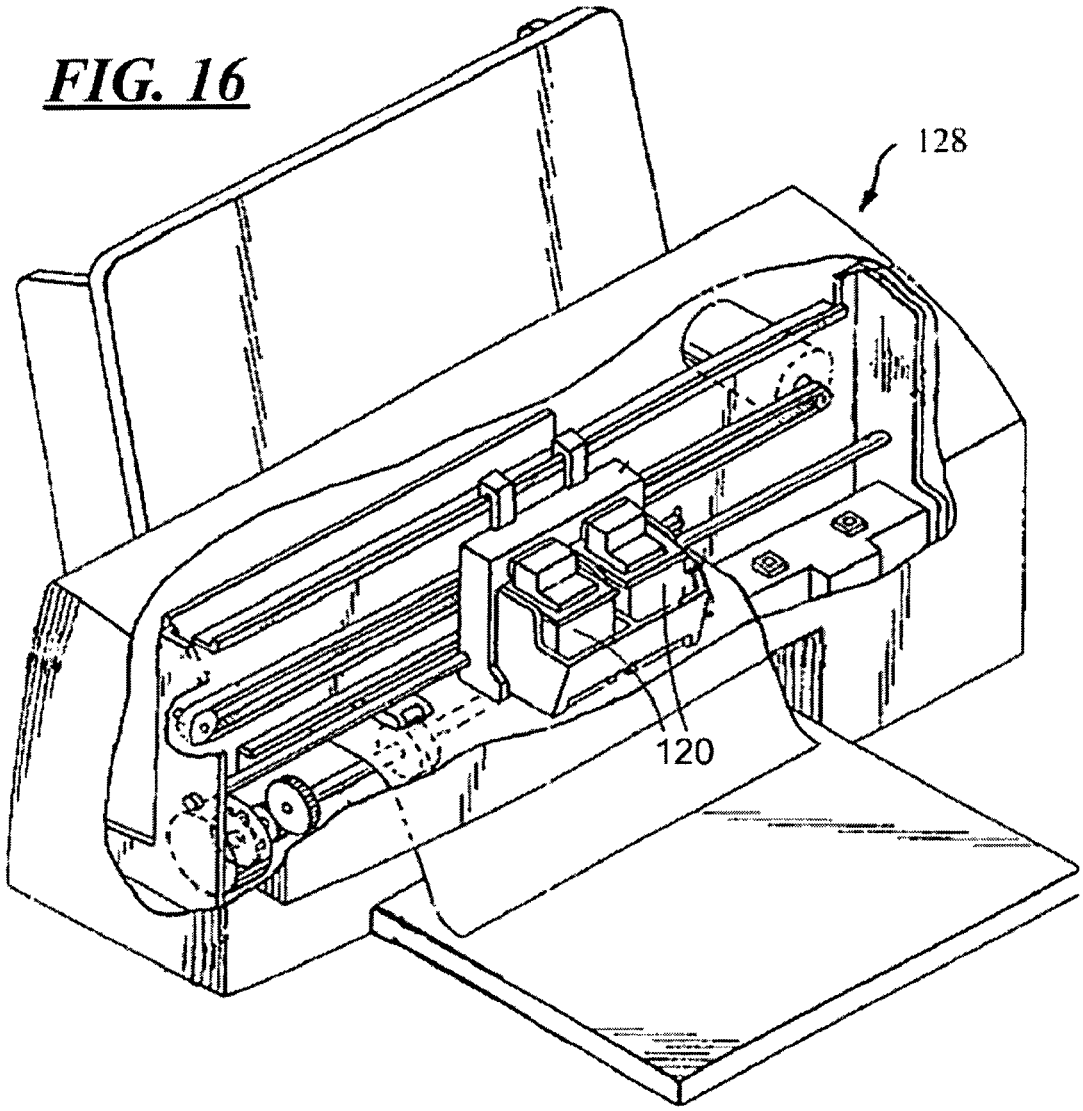
FIG. 16 is a perspective view, not to scale, of an ink jet printer containing micro-fluid ejection heads attached to the fluid reservoirs of FIG. 15.

A plan view of the micro-fluid ejection head 10 is illustrated in FIG. 14 wherein the nozzle member 54 containing nozzles 52 is attached adjacent the thick film layer 14 containing the flow channels 44, and fluid ejection chambers 46. The micro-fluid ejection head 10 may be attached to a fluid supply reservoir 120 as illustrated in FIG. 15. The fluid reservoir 120 includes a flexible circuit 122 containing electrical contacts 124 thereon for providing control and actuation of the fluid ejector actuators 16 on the substrate 12 via conductive traces 126. One or more reservoirs 120 containing the ejection heads 10 may be used in a micro-fluid ejection device 128, such as an ink jet printer as shown in FIG. 16 to provide control and ejection of fluid from the ejection heads 10. Other applications of the micro-fluid ejection head 10 will be evident to those skilled in the art.

Having described various aspects and exemplary embodiments and several advantages thereof, it will be recognized by those of ordinary skills that the disclosed embodiments is susceptible to various modifications, substitutions and revisions within the spirit and scope of the appended claims. For example, although the exemplary embodiments previously described herein might assume that all of the nozzles in a nozzle member should have a reentrant profiles, it is contemplated that other embodiments of the present invention may involve nozzle members where only some of the nozzles have such a reentrant profile.

What is claimed is:

1. A photoimaged nozzle member for a micro-fluid ejection head, the nozzle member comprising:

a photoresist nozzle layer attached to a thick film layer on a substrate having fluid ejector actuators, the photoresist nozzle layer derived from a composition comprising a first di-functional epoxy compound, a second di-functional epoxy compound, a polyhydroxy ether compound, a photoacid generator, and a solvent and having a plurality of nozzles therein, wherein the nozzles are formed in the nozzle layer from an exit surface of the nozzle layer to an entrance surface of the nozzle layer so that an exit diameter of the nozzles is smaller than an entrance diameter of the nozzles.

2. The nozzle member of claim 1, wherein the nozzles are aligned to the fluid ejector actuators.

3. The nozzle member of claim 1, wherein the nozzle layer has a thickness ranging from about 10 to about 20 microns.

4. The nozzle member of claim 1, wherein the composition is further comprised of an adhesion enhancing agent.

5. The nozzle member of claim 1, wherein the solvent is comprised of an aliphatic ketone solvent and acetone.

6. The nozzle member of claim 1, wherein the composition is comprised of from about 0.5 to about 5.0 percent by weight of the photoacid generator based on a total weight of the composition.

* * * * *